United States Patent [19]

Musante

[11] Patent Number: 5,024,176

[45] Date of Patent: Jun. 18, 1991

[54] NEEDLEPOINT SHEET HAVING OCTAGONAL OPENINGS AND METHOD OF USE THEREOF

[75] Inventor: Louis P. Musante, Fairview, Pa.

[73] Assignees: Louis P. Musante, Fairview, Pa.; Lynda S. Musante, Fairview, Pa.

[21] Appl. No.: 465,367

[22] Filed: Jan. 16, 1990

[51] Int. Cl.[5] ..... D03D 29/00

[52] U.S. Cl. ..... 112/266.1; 112/439; 434/95

[58] Field of Search ..... 112/266.1, 437, 439; 434/95

[56] References Cited

U.S. PATENT DOCUMENTS

| | | | |
|---|---|---|---|
| Re. 31,240 | 5/1983 | Mabry | 112/439 |
| 1,333,687 | 5/1920 | Strasburger . | |
| 4,284,021 | 8/1981 | Kaye | 112/402 |
| 4,372,238 | 2/1983 | Ciganko | 112/439 |
| 4,404,750 | 9/1983 | Marx et al. | 112/439 |
| 4,530,665 | 7/1985 | Colonel | 434/95 |
| 4,555,429 | 11/1985 | Martin | 428/131 |

FOREIGN PATENT DOCUMENTS

| | | | |
|---|---|---|---|
| 89833 | 2/1922 | Austria | 112/437 |

*Primary Examiner*—Werner H. Schroeder

*Assistant Examiner*—Jeanette E. Chapman

*Attorney, Agent, or Firm*—Wayne L. Lovercheck; Charles L. Lovercheck; Dale Lovercheck

[57] ABSTRACT

Needlepoint sheet having channel perforations with octagonal upper and lower openings. Thread drawn through a channel in a diagonal direction is pulled over a flat surface which widens the area covered by the thread. The needlepoint sheet is made of a polymeric material. The perforations are preferably formed into a plurality of aligned rows for receiving the thread. Each channel is enclosed by eight sides which form octagonal upper and lower openings. The width of each of the sides is substantially equal. In a preferred embodiment of the invention each of the sides form a plane, and the height of each of the side planes is substantially equal. In a preferred embodiment of the invention each of the side planes merge along a curved portion of the wall. This distributes the stress during bending of the needlepoint sheet, and reduces cracking and breakage thereof. In use thread is extended through the channels. At least two of the diagonal sides of each channel are normal to the diagonally positioned portion of the thread. The normal side over which the thread is drawn widens and thus maximize the coverage of the diagonally positioned portions of the thread supported thereby.

18 Claims, 3 Drawing Sheets

NEEDLEPOINT SHEET HAVING OCTAGONAL OPENINGS AND METHOD OF USE THEREOF

BACKGROUND OF THE INVENTION

The invention relates to a needlepoint sheet of flexible plastic material. In particular the improved needlepoint sheet provides a plurality of eight sided perforations therein for receiving thread-like material therethrough. In a preferred embodiment of the invention each of the sides forms a plane. The height and width of each of the side planes is substantially equal. The improvements of the invention each taken alone or in combination add to resolve the problems of the prior art. The prior art does not provide a needlepoint sheet of flexible plastic material having a plurality of eight sided perforations therein for receiving thread-like material therethrough.

Marx et al. in U.S. Pat. No. 4,404,750 disclose a needlepoint sheet having four sided perforations enclosed on four sides. Kaye in U.S. Pat. No. 4,284,021 discloses a fabric having triangular shaped pores for embroidery. Mabry in U.S. Pat. No. Re. 31,240 discloses a needlework technique using ribbon in a needlework canvas having four sided openings. Martin in U.S. Pat. No. 4,555,429 discloses a curved needlepoint canvas having four sided perforations. Ciganko in U.S. Pat. No. 4,372,238 discloses a toy stitching set having a stitching grid with four sided perforations. Strasburger in U.S. Pat. No. 1,333,687 discloses an oramental mesh having four sided openings.

It is an object of the invention to provide a needlepoint sheet of flexible plastic material having a plurality of channels each enclosed by a channel wall having eight sides wherein the channels are adapted to receive thread-like material therethrough.

It is an object of the invention to provide a needlepoint sheet of flexible plastic material having a plurality of channels each enclosed by a channel wall having eight sides which form octagonal openings at both the upper and lower end portions of each channel and wherein the channels are adapted to receive thread-like material therethrough.

It is an object of the invention to provide a needlepoint sheet of flexible plastic material having a plurality of channels each enclosed by a channel wall having eight planar sides and wherein each planar side is connected to two curved portions of the channel wall and wherein the channels are adapted to receive thread-like material therethrough.

It is an object of the invention to provide a needlepoint sheet having first, second and third channels formed therein, wherein each channel is enclosed by eight sides forming an octagonal upper opening enclosed by eight substantially straight edges of the eight sides.

It is an object of the invention to provide a needlepoint sheet having first, second and third channels formed therein, wherein each channel is enclosed by eight sides forming an octagonal upper opening enclosed by eight substantially straight edges of the eight sides, and wherein the first and second channels are positioned along a first line, the first and third channels being positioned along a second line, and wherein the first and second lines intersect at an acute angle.

One problem of the prior art is that the needlepoint sheets have four sided perforations having rectangular upper and lower openings. Prior art needlepoint sheets do not provide flat surfaces over which to draw thread in both diagonal and orthogonal directions. Needlepoint sheets having octagonal upper and lower openings provide a flat surface over which to draw thread in diagonal and orthogonal directions. Thread drawn over a flat surface flattens the thread and widens the area covered thereby. Another problem of the prior art is that the orthogonal sides of the perforations tend to crack at the corners, i.e. the intersection of the adjacent sides. The improvements of the present invention beneficially provide a novel, nonobvious and useful manner of providing needlepoint sheets which are adapted to provide a flat surface over which to draw thread in diagonal and orthogonal directions.

BRIEF DESCRIPTION OF THE INVENTION

These problems of the prior art are overcome by the improved needlepoint sheet having octagonal upper and lower openings of the present invention. Thread drawn in a diagonal direction is pulled over a flat surface which widens the area covered thereby. Cracking at the corners of the perforations is reduced in a needlepoint sheet having octagonal upper and lower openings in accordance with the present invention.

In accordance with the invention a needlepoint sheet of polymeric material is provided having a plurality of perforations forming channels therein. The perforations are formed into a plurality of aligned rows for receiving thread-like material therethrough. Each channel is enclosed by eight sides which form octagonal upper and lower openings. The height of each of the side planes is substantially equal. In a preferred embodiment of the invention each of the sides form a plane, and the width of each of the side planes is substantially equal. In a preferred embodiment of the invention each of the side planes merge along an arc. This distributes the stress during bending of the needlepoint sheet, and reduces cracking and breakage thereof. In use at least one thread-like member is extended through at least one of the channels. The diagonal sides of each channel are normal to a diagonally positioned portion of a thread-like member. The diagonal sides widen and thus maximize the coverage of the diagonally positioned portions of the thread-like members supported thereby.

BRIEF DESCRIPTION OF THE DRAWINGS

The objects features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
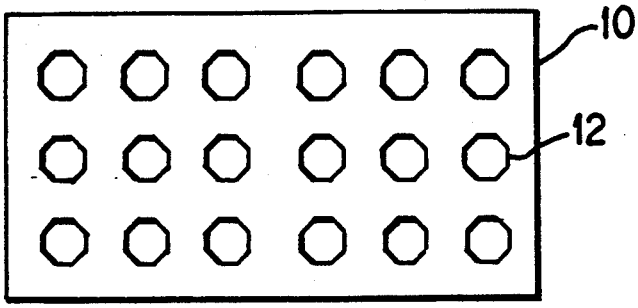
FIG. 1 is a top view of a needlepoint sheet in accordance with the invention.
Figure 2:
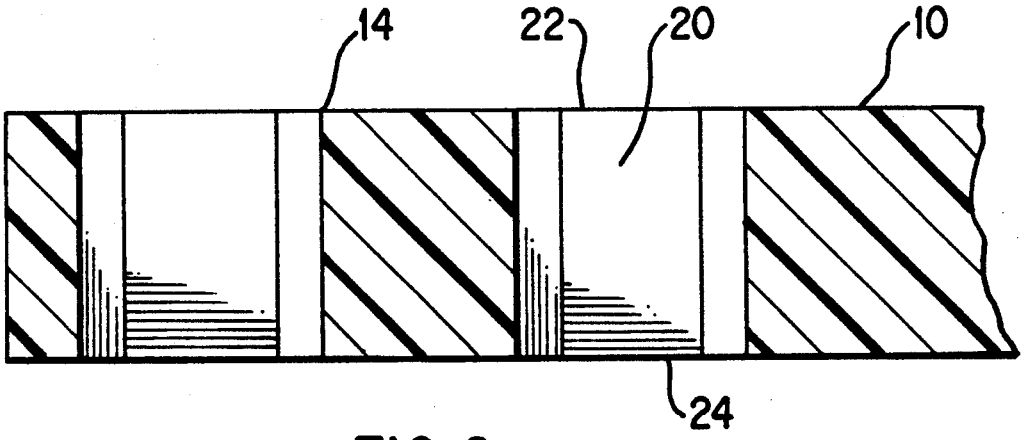
FIG. 2 is a partial cross-sectional side view of a needlepoint sheet having eight sided channels therethrough in accordance with the invention.

The preferred embodiment of the invention is illustrated by way of example in FIGS. 1–4A. Referring to the Figures, in which like numerals refer to like portions thereof FIGS. 1 and 2 show needlepoint sheet 10 of polymeric material in accordance with the present invention. The needlepoint sheet has a plurality of perforations 12 forming channels 14 therein. Perforations 12 are formed into a plurality of aligned rows for receiving thread-like material therethrough. Each channel 14 is enclosed by eight sides 20 which form octagonal upper and lower openings 22 and 24 respectively.

In the preferred embodiment of the invention shown in FIG. 2 each of sides 20 forms a plane, and the widths of each of sides 20 are substantially equal. Needlepoint sheet 10 preferably includes a plastic material. Preferably, the plastic material is a thermoplastic hydrocarbon polymer, for example polypropylene or polyethylene. In use at least one member of thread-like material is extended through at least one of channels 14. The diagonal sides of each channel are normal to portions of a thread-like member positioned between diagonally aligned channels. The diagonal sides widen and thus maximize the coverage of the diagonally positioned portions of the thread-like members supported thereby.

Figure 2A:
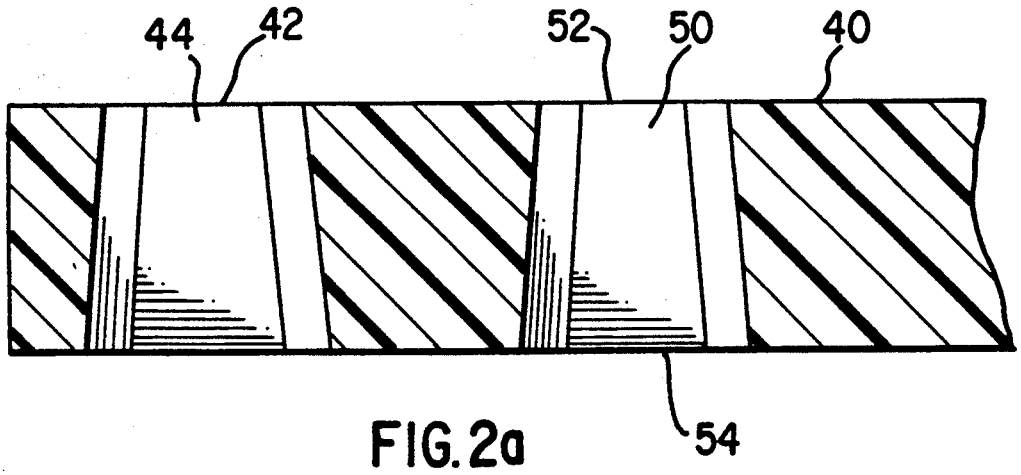
FIG. 2A is a partial cross-sectional side view of a needlepoint sheet having pyramid frustrum eight sided channels therethrough in accordance with the invention.

FIG. 2A shows needlepoint sheet 40 of polymeric material in accordance with the present invention. The needlepoint sheet has a plurality of perforations 42 forming channels 44 therein. Channel side walls 50 form a pyramid frustrum shape. Each channel 44 is enclosed by eight sides 50 which form octogonal upper and lower openings 52 and 54 respectively.

In the preferred embodiment of the invention shown in FIG. 2A each of sides 50 forms a plane, and the height of each of sides 50 is substantially equal. The width of each of sides 50 is smaller at upper octagonal opening 52 than at lower octagonal opening 54.

Figure 3:
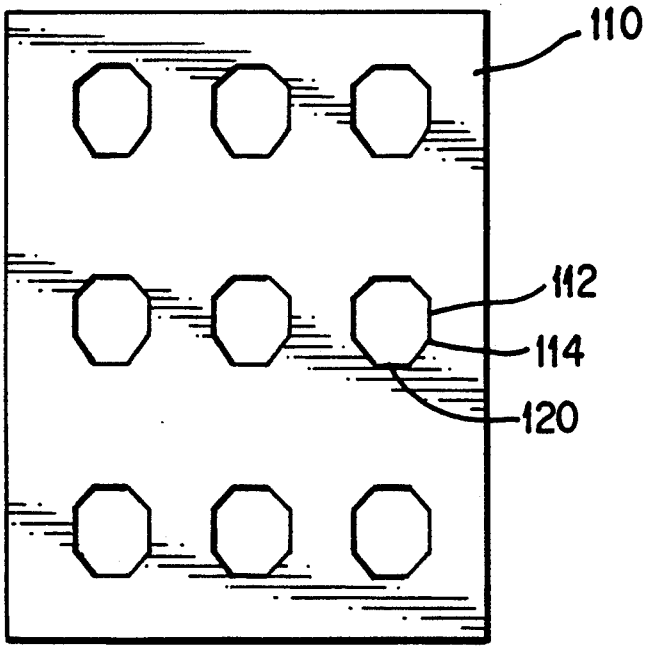
FIG. 3 is a top view of a needlepoint sheet having eight planar sides and eight curved side portions in accordance with the invention.
Figure 3A:
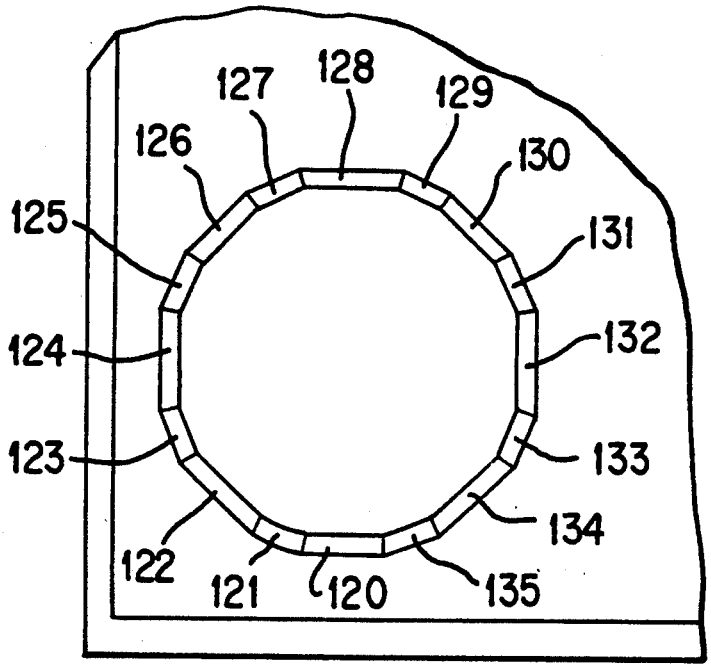
FIG. 3A is a partial top perspective view of a needlepoint sheet in accordance with the invention.

With more particular reference to FIGS. 3 and 3A needlepoint sheet 110 is seen having channels 112 with octagonal openings 114. Needlepoint sheet 110 preferably is made of a polymeric material. Channels 112 are preferably formed into a plurality of aligned rows for receiving thread. Each channel 112 is enclosed by eight planar sides 120, 122, 124, 126, 128, 130, 132 and 134. These sides may be seen as four pairs of parallel planar sides 120 and 128, 122 and 130, 124 and 132, and 126 and 134. These sides are positioned in four pairs of orthogonal planes. Sides 120 and 128 are positioned in a pair of planes which are orthogonal to the planes of sides 124 and 132. Sides 122 and 130 are positioned in a pair of planes which are orthogonal to the planes of sides 126 and 134. Sides 120, 122, 124, 126, 128, 130, 132 and 134 form octagonal upper and lower openings. The height of each of the sides is substantially equal. Each of the planar sides merge along a curved portion of the wall. This distributes the stress during bending of the needlepoint sheet, and reduces cracking and breakage thereof. In use thread is extended through the channels. At least two of the diagonal sides of each channel are normal to the diagonally positioned portion of the thread. The normal side over which the thread is drawn widens and thus maximize the coverage of the diagonally positioned portions of the thread supported thereby. Sides 120 and 122 merge into curved wall 121. Sides 122 and 124 merge into curved wall 123. Sides 124 and 126 merge into curved wall 125. Sides 126 and 128 merge into curved wall 127. Sides 128 and 130 merge into curved wall 129. Sides 130 and 132 merge into curved wall 131. Sides 132 and 134 merge into curved wall 133. Sides 134 and 120 merge into curved wall 135.

Figure 4:
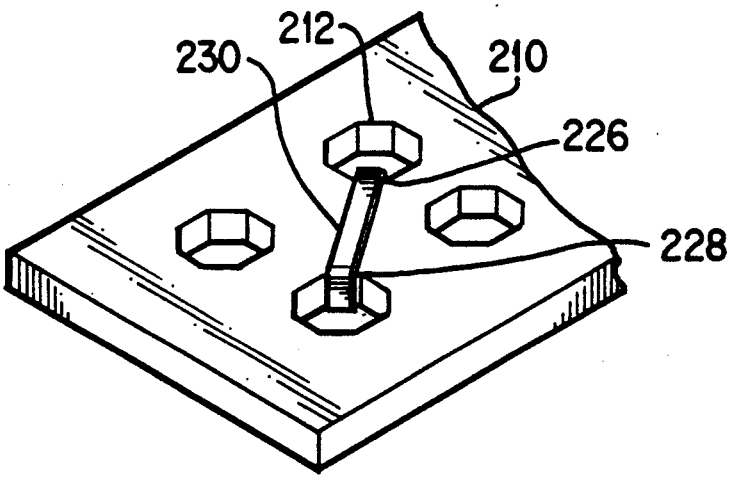
FIG. 4 is a partial perspective view of a needlepoint sheet in accordance with the invention shown with thread-like material supported thereby.
Figure 4A:
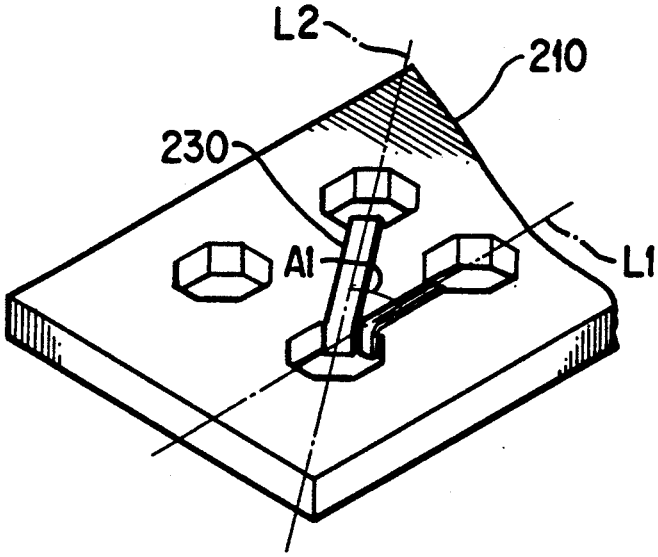
FIG. 4A is a partial perspective view of a needlepoint sheet in accordance with the invention shown with thread-like material supported thereby.

With more particular reference to FIGS. 4 and 4A needlepoint sheet 210 of polymeric material is seen in accordance with the present invention. Needlepoint sheet 210 has a plurality of perforation channels 212 therethrough. Each channel 212 is enclosed by eight sides which form octagonal upper and lower opening. Thread 230 is drawn along line L2 thought channels 226 and 228 in a diagonal direction over the flat surface of the upper edge of the diagonal channel wall which widens the area covered by the thread. Another thread is drawn along line L1 through channel 228 and a channel positioned orthogonally to channels 226 and 228. Lines L1 and L2 intersect at an acute angle A1. Preferably, the acute angle between lines L1 and L2 is from about 30 to about 70 degrees.

In use a needlepoint sheet of polymeric material is provided. The sheet has at least three channels formed therethrough. Each channel is enclosed by eight sides forming an octagonal upper opening enclosed by eight substantially straight edges of the eight sides. A first and second channel are positioned along a first line. The first and third channels are positioned along a second line. The first and second lines intersect at an acute angle. A thread-like material is then positioned along the first and second lines through the first, second and third channels. The flat orthogonal and diagonal edges of the channels widen the coverage of the thread-like material.

While the present invention has been disclosed in connection with the preferred embodiment thereof, it should be understood that there may be other embodiments which fall within the spirit and scope of the invention as defined by the following claims.

What is claimed is:

1. A needlepoint sheet of flexible plastic material, comprising:

a sheet of flexible plastic material having a plurality of channels therethrough for receiving thread-like material, each of said channels being enclosed by a channel wall having eight sides.

2. The needlepoint sheet recited in claim 1 wherein each of said sides is planar.

3. The needlepoint sheet recited in claim 2 wherein each of said sides has a height, the heights of each of said sides being substantially equal.

4. The needlepoint sheet recited in claim 2 wherein said channel wall further comprises eight curved portions, and wherein each said planar side is connected to two said curved portions of said channel wall.

5. The needlepoint sheet recited in claim 1 wherein each said channel wall comprises an upper and lower end portion, and said eight sides form octagonal openings at both said upper and lower end portions of each said channel.

6. The needlepoint sheet recited in claim 1 wherein said channel walls form a pyramid frustrum shape.

7. The needlepoint sheet recited in claim 1 wherein said channels are aligned in rows and columns, and said plastic material comprises a thermoplastic hydrocarbon polymer.

8. A needlepoint sheet, comprising:

a sheet of polymeric material, said sheet having a plurality of channels formed therein, each said channel being enclosed by eight sides, said eight sides forming an octagonal upper opening enclosed by eight substantially straight edges of said eight sides, said channels being positioned in an array forming rows and columns and diagonals, said channels being positioned so that the adjacent sides of adjacent channels are paralled to each other by row, by column and by diagonal.

9. The needlepoint sheet recited in claim 8 wherein each of said sides forms a plane.

10. The needlepoint sheet recited in claim 9 wherein each of said sides has a height, the heights of each of the sides being substantially equal.

11. The needlepoint sheet recited in claim 10 further comprising:

providing a thread-like member, said thread-like member extending along said first and second lines and through said first, second and third channels.

12. The needlepoint sheet recited in claim 8 wherein said eight sides form an octagonal lower opening enclosed by eight substantially straight edges of said eight sides.

13. The needlepoint sheet recited in claim 8 wherein said channel walls form a pyramid frustrum shape.

14. A method of using a needlepoint sheet, comprising:

providing a sheet of polymeric material, forming a plurality of channels in said needlepoint sheet, enclosing each said channel by eight sides, said eight sides forming an octagonal upper opening enclosed by eight substantially straight edges of said eight sides, positioning said channels in an array of rows and columns and diagonals, said channels being positioned so that the adjacent sides of adjacent channels by row, by column and by diagonal are paralled to each other, positioning a thread-like material through adjacent channels in desired patterns along rows, columns and diagonals, the thread laying against said adjacent parallel sides.

15. The method of using a needlepoint sheet recited in claim 14 wherein each of said sides forms a plane.

16. The method of using a needlepoint sheet recited in claim 15 wherein each of said sides has a height, the heights of each of the sides being substantially equal.

17. The method of using a needlepoint sheet recited in claim 14 wherein said eight sides form an octagonal lower opening enclosed by eight substantially straight edges of said eight sides.

18. The method of using a needlepoint sheet recited in claim 15 wherein each said channel wall further comprises eight curved portions, and wherein each said planar side is connected to two said curved portions of said channel wall.

* * * * *